United States Patent [19]

Bornkast et al.

[11] Patent Number: 4,651,160

[45] Date of Patent: Mar. 17, 1987

[54] EARTH STATION ANTENNA SHIELD

[75] Inventors: Horst Bornkast, Fairfax Station, Va.; Edward J. Kawczynski, Gaithersburg, Md.

[73] Assignee: American Satellite Company, Rockville, Md.

[21] Appl. No.: 500,421

[22] Filed: Jun. 2, 1983

[51] Int. Cl.[4] ..... H01Q 1/04; H01Q 1/52; H01Q 17/00

[52] U.S. Cl. ..... 343/719; 343/914; 342/4

[58] Field of Search ..... 343/18 R, 18 A, 18 B, 343/719, 911, 914

[56] References Cited

FOREIGN PATENT DOCUMENTS 55-37272 10/1981 Japan ..... 343/912

OTHER PUBLICATIONS

Fanwall, Project Report F-36, The Fanwall Corp., 1983.

Ekco; vol. 18, No. 2, Nov. 1982.

*Primary Examiner*—Eli Lieberman

*Attorney, Agent, or Firm*—Saidman, Sterne, Kessler & Goldstein

[57] ABSTRACT

A shield for a satellite earth station located in a dense radio frequency environment. The shield includes a satellite earth station antenna position in a pit. Surrounding the pit is a tear-shaped earthen berm. Positioned on top of the berm is a wall made of a series of modular precast concrete panels specially designed to reduce the diffraction of radio frequency interference over the top of the panels and to minimize the internal reflection of radio frequency interference. The panels each include an inner face of two sets of horizontal slats set at alternating angles. The two sets of slats are designed to attenuate and disperse radio frequency interference in the range of the satellite communication downlink and uplink frequencies. In addition, the present invention includes specially shaped grooves cast into the top face of the panels which attenuate radio frequency interference passing over the top of the wall.

48 Claims, 5 Drawing Figures

EARTH STATION ANTENNA SHIELD

BACKGROUND OF THE INVENTION

1. Field of the Invention

The present invention relates generally to shields for protecting antennas from undesirable radio frequency interference. More particularly, the present invention relates to a shield for protecting a satellite earth station antenna from interference in dense radio frequency environments.

2. Description of the Related Art

Generally, in any communication link between a receiver and a transmitter, proper shielding is required to prevent undesirable external signals from degrading the communication signal. In the case of satellite communication between an earth station antenna and a satellite transponder, it is important that the earth station be adequately protected from undesirable radio frequency signals surrounding its particular location on the earth.

In order to minimize the effect of harmful interference, it is sometimes desirable to situate an earth station at an appreciable distance from the urban point or points it is to service so that sufficient isolation exists between potential interfering communication systems which share the same frequency spectrum. This is particularly true in regions where there are few hills or valleys to provide natural site shielding for the earth station. If it is impractical or otherwise undesirable to locate an earth station in a remote area, artificial site shielding must be used to provide insulation between potentially interfering stations.

If an earth station is to be placed in an urban environment, it must not only be protected from radio frequency interference, but it must be designed so that it does not transmit appreciable interference into terrestrial stations of other carriers (i.e., competitors) in the vicinity. The other carriers in the area may effectively veto an FCC license for an earth station designed with inadequate shielding.

These competitors also reserve the right to perform interference measurements after the earth station facility has been built. If measurements show that interference is being transmitted to surrounding terrestrial stations, the owner of the new facility is required to eliminate that interference. Thus, a very high degree of risk is involved in building an earth station that may not meet the necessary interference standards. Fixing or eliminating such interference, once a structure is built, can be extremely expensive, if not impossible.

One manner of shielding an earth station antenna in a dense radio frequency environment has been to try to take advantage of the urban "landscape" by locating the antenna between tall buildings in such a manner so as to utilize the natural shielding provided by the buildings. However, such a location is not always available or desirable or positioned in the optimum fashion. Additionally, the typical building surfaces of such structures can tend to reflect towards the antenna undesirable interference signals that manage to enter the zone of the "natural" shield.

Metal fences have also typically been used to shield earth station antennas from radio frequency interference. These highly reflective fences are usually constructed of a metal screening having a mesh size which is a significantly small fraction of the wavelength of interest to limit energy transmission through the fence to an acceptable level. While such fences are an inexpensive solution to eliminating radio frequency interference, they are susceptible to adverse weather conditions and may require periodic maintenance. Moreover, while metal fences may perform quite well in less dense radio frequency environments, they do not always provide adequate protection in more demanding situations. For example, in a shield constructed of a metal fence that surrounds the antenna, energy diffracting over the top of the fence is projected against the opposing fence inner surface and is reflected toward the earth station antenna. Conversely, stray signals transmitted by the earth station may cause interference to other carriers through the opposite propogation path.

Another method widely used to protect earth station antennas has been to place the antenna in a deep ground depression or pit. An article by Edward F. Lucia, Jr. entitled "Artificial Site Shielding For Communications Satellite Earth Stations," IEEE Transactions on Aerospace and Electronic Systems, Volume AES-6, Number 5, September 1970, discloses the use of pit shielding for microwave earth station antennas. While such pits provide adequate shielding, even in dense radio frequency environments, they must be quite deep if they are to provide an adequate shield for the antenna. Such deep pits require a substantial amount of excavation and hence may be prohibitively expensive in many instances. Moreover, since such pits extend a substantial distance into the earth, they may be accompanied by severe water problems, such as accumulation of rainwater in the pit or underground water seepage into the pit.

Another common means for reducing radio frequency interference is to build an earthen berm around an earth station. While the use of a berm is effective in reducing radio frequency interference, such a berm must be built quite high to provide adequate shielding. The construction of a berm of adequate height requires a great deal of earth fill, thereby substantially escalating the cost of the earth station facility.

Moreover, since the slope of either a deep pit or a tall earthen berm is limited due to structural retaining considerations, both alternatives can require a large tract of land, which is frequently unavailable or too expensive at the desired site.

The combination of a metal fence positioned on top of an earthen beam is disclosed as prior art in U.S. Pat. No. 3,495,265 to Phillip H. Smith, entitled "Dielectric Clutter Fence". However, as discussed in the initial portion of the Smith patent, such a shield requires a high metal fence which is expensive to construct and is not completely satisfactory in reducing undesired electromagnetic energy from reaching the antenna. Alternatively, Smith proposes a dielectric fence which does not prevent the interfering signals from impinging on the antenna, but relies instead on being able to intecept and reverse the phase by 180° of 50 percent of the interfering energy, thereby attempting to cancel interference at the antenna. While this approach may be practical for a single frequency with a fixed arrival angle, it does not lend itself to multiple frequency ranges or to interfering signals with varying angles of arrival, as is typically the case in an earth station environment.

OBJECTS OF THE INVENTION

It is therefore a primary object of the present invention to provide a shield for an earth station antenna situated in an urban environment without the above-mentioned attendant disadvantages.

Another object of the present invention is to provide a shield for an earth station antenna which both protects the antenna from undesirable interference and reduces the amount of interference leaving the earth station which could interfere with terrestial microwave facilities operated by other carriers.

A further object of the present invention is to provide a shield for an earth station which does not require an extensive amount of excavation or a great amount of earth fill.

An additional object of the present invention is to provide a shield for an earth station antenna which eliminates the need for a high metal fence surrounding the antenna.

A still additional object of the present invention is to provide a shield for an earth station antenna which is less reflective and requires less maintenance than a typical metal fence.

A still further object of the present invention is to provide a shielding structure that is aesthetically pleasing and can be erected quickly on a relatively small parcel of land.

Another object of the present invention is to provide a shield for an earth station antenna that both reflects away and attenuates undesirable interference with a single structure.

Another object of the present invention is to provide a shield for an earth station antenna which reduces the amount of diffraction of undesirable interference that occurs over the top of the shield.

Another object of the present invention is to provide a shield for an earth station antenna which may be constructed in an inexpensive, modular fashion from a readily available building material.

SUMMARY OF THE INVENTION

The foregoing and other objects are attained in accordance with one aspect of the present invention through the provision of apparatus which comprises a pit, an antenna positioned in the pit, an earthen berm surrounding the pit and the antenna, and a wall positioned on the earthen berm. The wall preferably comprises a plurality of precast concrete panels.

In accordance with more specific aspects of the present invention, the wall includes an inner face and a top face. First and second shielding means are formed on the inner and outer faces of the wall for shielding the antenna from electromagnetic energy of first and second wavelengths, respectively. The first and second shielding means reflect away and attenuate electromagnetic energy of the first and second wavelengths, respectively. The first shielding means on the inner face of the wall preferably comprises at least two parallel slats each having a substantially planar first reflective face extending at a first angle from the vertical. The perpendicular distance between the first reflective faces is substantially equal to one-half of the first wavelength.

Similarly, the second shielding means on the inner face of the wall comprises at least two additional parallel slats each having a substantially planar second reflective face extending at a second angle from the vertical. The perpendicular distance between the second reflective faces is substantially equal to one-half of the second wavelength.

In this way, destructive interference of the interfering electromagnetic energy is caused to occur, and the reflected energy is directed out of the earth station installation area.

In accordance with additional aspects of the present invention, the first reflective faces are preferably interleaved with the second reflective faces. The first wavelength may correspond to a satellite communications downlink frequency of approximately 4 GHz, and the second wavelength may correspond to a satellite communications uplink frequency of approximately 6 GHz.

In accordance with other aspects of the present invention, the first and second shielding means on the top face of the wall comprises at least first and second longitudinally extending grooves, respectively. The first groove comprises a first side wall and a first bottom wall, and the second groove comprises a second side wall and a second bottom wall. The height of the first side wall is substantially equal to one-quarter of the first wavelength, while the height of the second side wall is substantially equal to one-quarter of the second wavelength. This arrangement also aids attenuation of the interfering signals.

By virtue of the foregoing, the present invention provides an optimum system for both protecting the antenna from extraneous signals, as well as reducing the amount of interference leaving the earth station which could interfere with neighboring carriers. Due to its excellent shielding capability, the present invention allows a satellite earth station to be located in close proximity to metropolitan areas and other transmitting equipment. Moreover, the present invention does not require an extensive amount of excavation, nor does it require a great amount of earth fill for a tall earthen berm. The configuration of the present invention is specially designed to accommodate the low angle receiving and transmitting capability of the satellite antenna when it is directed toward the lower extremes of the satellite orbit.

The present invention advantageously utilizes precast concrete panels with a novel dispersive inner face. This surface both attenuates and disperses undesirable radio frequency signals to achieve the desired signal-to-interference ratio for the earth sation antenna. In contrast, conventional concrete wall building structures tend to reflect, rather than disperse, signals entering an enclosure and thereby increase the radio interference within the structure.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
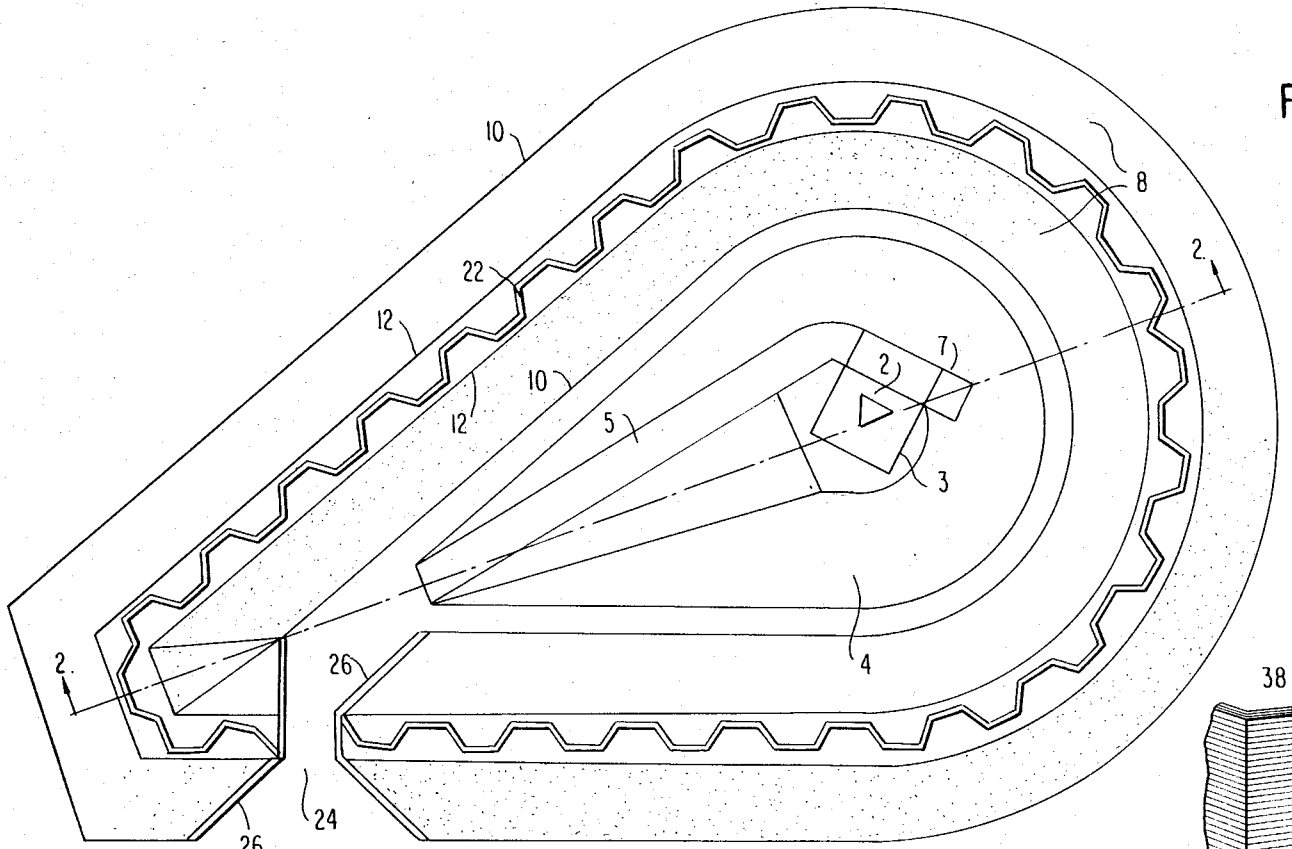
FIG. 1 is a top view of an earth station installation in accordance with the present invention.
Figure 2:
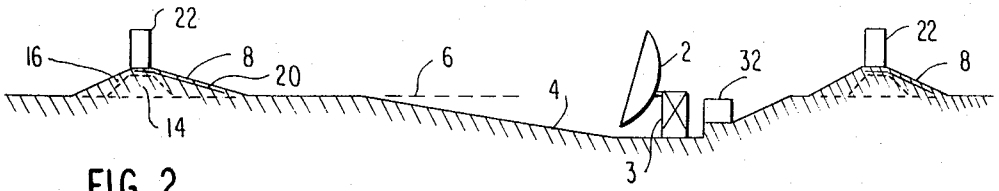
FIG. 2 is sectional view of the installation of FIG. 1 taken along line 2—2 thereof.

Briefly, in the preferred embodiment the present invention comprises a shield for a satellite earth station antenna. Referring first to FIGS. 1 and 2, the present invention includes a satellite earth station antenna 2 located in a pit 4. Antenna 2 may, for example, comprise a conventional eleven meter satellite dish antenna. As shown in FIG. 2, pit 4 preferably slopes downward from the preexisting ground line 6 and then levels off, with antenna 2 being supported at the lowest point of pit 4 by a suitable support structure 3. In an installation built at Somerset, N.J., (hereafter: "the Somerset installation") to verify the principles of the present invention, pit 4 is fifteen feet deep.

Since antenna 2 is positioned at the bottom of pit 4, a sloped driveway/walk 5 is preferably provided for access and service of antenna 2 and the associated antenna electronics which may be contained in a box 7 adjacent to the antenna.

Surrounding antenna 2 and pit 4 is an earthen berm 8. Berm 8 is preferably symmetrical, sloping upward from a toe 10 to a tip 12. To increase the support capability of berm 8, a structural embankment 14 may be provided in the center portion of berm 8. Covering structural embankment 14 is backfill 16, which is preferably comprised of an earthen based material. For asthetic purposes, grass may be provided on the outer surface of berm 8. Also, on the inner surface, a rip-rap blanket 20 of loose rock or stone may be provided on berm 8 to stabilize the soil. Advantageously, blanket 20 also provides a rough surface to reduce any reflection of electromagnetic energy from berm 8. In the Somerset installation, berm 8 is ten feet high.

In accordance with the present invention, a wall 22 is positioned on top of berm 8. Wall 22 provides a single structure which both attenuates and reflects undesirable electromagnetic interference away from antenna 2. In order to provide an effective barrier to electromagnetic interference, wall 22, in accordance with the present invention, is preferably comprised of a material with low penetration and high absorption characteristics for the undesired frequencies. Any type of earthen based material, such as concrete, brick, cinderblock, or sand will, in accordance with the invention, function effectively in reducing interference of satellite communication signals. In the preferred embodiment, wall 22 is formed of a series of concrete panels 23, which may comprise, for example, Fanwall brand precast concrete panels whose inside faces and top faces are modified in a manner to be explained in greater detail below. Advantageously, these panels are relatively inexpensive and easy to construct. Moreover, the structural integrity of concrete panels results in an essentially maintenance-free structure which is relatively insusceptible to adverse weather conditions, such as heavy snow, ice, and high winds.

Panels 23 may be coupled together by any conventional means. For example, in the preferred embodiment, stainless steel connectors are used to secure panels 23 together. For increased absorption of electromagnetic energy, carbon may optionally be added to the concrete mix used to form panels 23, or may be applied to the inner surfaces and the top of the panels after fabrication.

As shown in FIG. 1, panels 23 can be arranged in an alternating staggered pattern of concave-convex connections. The resultant configuration gives wall 22 free-standing capability, and eliminates the requirement for a foundation. For additional support, wall 22 may be embedded two feet into the top of berm 8. The overall tear-shaped layout of wall 22 was provided in the Somerset installation to allow low elevation operation of antenna 2 in the direction of the lower limit of the satellite orbit. The shape of wall 22 for a given earth station installation depends on the geographic location of antenna 2 on the earth relative to the position of the communication satellites in space. The modular nature of the shield permits selective application of individual interfering azimuths in cases where complete 360° shielding on the earth station antenna is not required.

Referring still to FIG. 1, an entrance 24, bounded by a pair of wing walls 26, may be provided through berm 8 and wall 22 to allow personnel and equipment to access the inside of the installation for inspection and maintenance of antenna 2. Note that entrance 24 in this embodiment is configured such that antenna 2 is blind to the opening, i.e., the overlapping sections of wing walls 26 with respect to the position of antenna 2 provide an unbroken shield.

In the Somerset installation, wall 22 is eight feet wide, eight inches thick, and sixteen feet high. This design results in the top of wall 22 being at least as high as the top of antenna 2, thus providing proper shielding for the entire antenna. Depending on the physical size of the earth station antenna, wall 2 may be used without any excavation or berm.

Figure 3:
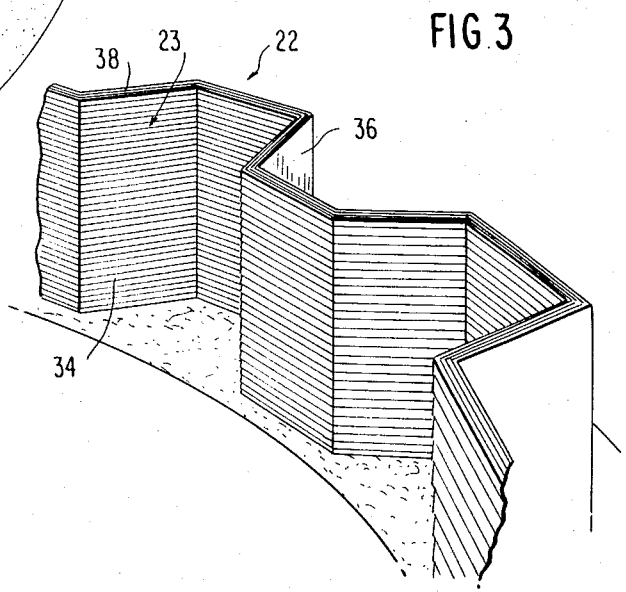
FIG. 3 is a perspective view of a portion of the wall of the present invention positioned on top of an earthen berm.

Referring now to FIG. 3, a perspective view of wall 22 is illustrated showing a portion of panels 23 coupled in the alternating pattern described above. Each panel 23 includes an inner face 34, an outer face 36, and a top face 38.

Figure 4:
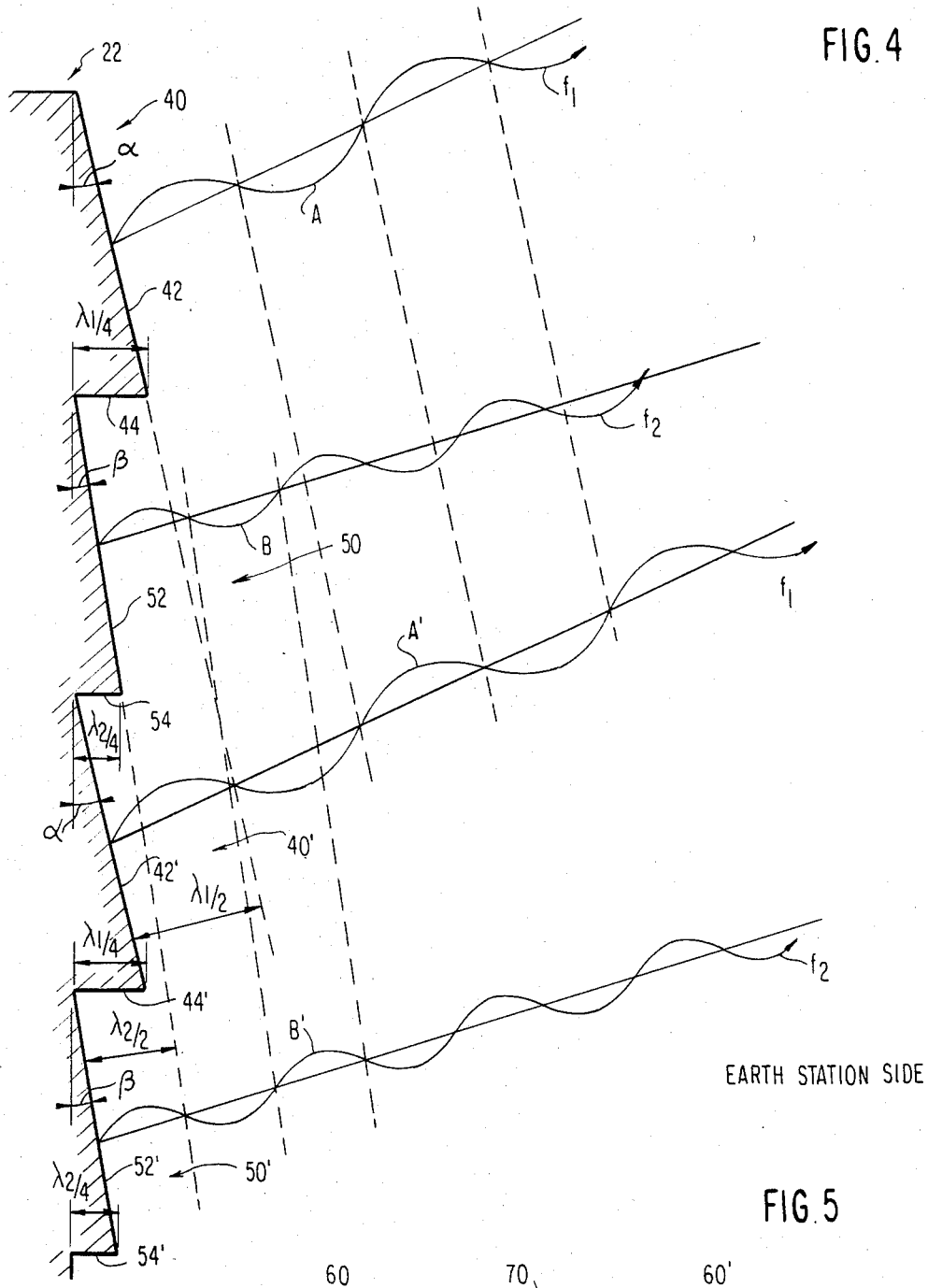
FIG. 4 is a sectional view showing the inner face of the wall of FIG. 3 in accordance with the present invention.

Referring now to FIG. 4, the inner face 34 of wall 22 is illustrated in greater detail in a side sectional view. Inner face 34 is preferably comprised of a plurality of shingle-like slats designated generally by reference numerals 40, 50, 40' and 50'. Slat 40 includes a reflective face 42 and a transition face 44. Reflective face 42 is preferably a substantially planar surface oriented at an angle $\alpha$ from the vertical plane of wall 22. Transition face 44 may also be a planar surface that extends substantially horizontally with respect to wall 22.

Slat 40' includes a corresponding reflective face 42' and a transition face 44'. Reflective face 42' is set at the same angle $\alpha$ from the vertical as reflective face 42, thereby causing the two reflective faces 42 and 42' to be parallel to each other.

Since faces 42 and 42' are parallel, an electromagnetic wave of frequency $f_1$ striking each of slats 40 and 40' in a horizontal direction will be reflected upwardly from slats 40 and 40' in exactly the same direction. The reflected portions of the wave are schematically indicated in FIG. 4 by reference letters A and A'. The angled orientation of slats 40 and 40' advantageously directs electromagnetic energy reflected inside wall 22 away from the earth station.

Slats 40 and 40' are designed so that the perpendicular distance between reflective surfaces 42 and 42' is equal to one half the wavelength of the electromagnetic wave of frequency $f_1$ of $\lambda_1/2$. Hence, a portion of a wave of frequency $f_1$ reflected from reflective face 42' will travel one-half a wavelength further than another portion of the wave reflected from reflective face 42. For this reason, and since the two portions of reflected wave $f_1$ are reflected upwardly in a parallel direction, they will wind up being 180° out of phase. Specifically, referring to FIG. 4, the upper reflected wave A and the lower reflected wave A', being 180° or a half-wavelength out of phase, will tend to cancel each other. Hence, the reflective energy of frequency $f_1$ will be attenuated.

Slats 40 and 40' thus serve two primary purposes: first, due to their upwardly angled orientation, they reflect any incident electromagnetic energy up and out of the earth station installation; second, the perpendicular, half-wavelength spacing between reflective faces 42 and 42' causes attenuation of electromagnetic energy of a frequency of approximately $f_1$. The angled orientation of slats 40 and 40' also advantageously reduces the reflective effect of rain water on inner face 34.

Transition faces 44 and 44' are preferably designed to have a length approximately equal to one-quarter the wavelength of the electromagnetic wave of frequency $f_1$, or $\lambda_1/4$. Advantageously, this design results in at least partial attenuation of waves of frequency $f_1$ reflected from adjacent slats near transition faces 44 and 44', since the two reflected waves will be approximately 90° out of phase.

In the Somerset installation, the length of reflective faces 42 and 42' is 88 mm. and the length of transition faces 44 and 44' is 19 mm. ($\lambda_1/4$). These two lengths result in the angle $\alpha$ of slats 40 and 40' being 12.5°. These dimensions are designed to cause attenuation of signals having a frequency in the range of 4 GHz, corresponding approximately to a typical satellite downlink frequency.

A second pair of slats 50 and 50' may be provided for the satellite uplink frequency. As shown in FIG. 4, slats 50 and 50' are preferably (although not necessarily) oriented at a different angle $\beta$. Slats 50 and 50' include reflective faces 52 and 52', respectively, as well as transition faces 54 and 54'. The perpendicular distance between reflective faces 52 and 52' is equal to one-half the wavelength of an electromagnetic wave of frequency $f_2$, or $\lambda_2/2$.

Transition faces 54 and 54' are preferably designed to have a length approximately equal to one-quarter the wavelength of the electromagnetic wave of frequency $f_2$, or $\lambda_2/4$. This results in at least some attenuation of waves of frequency $f_2$ reflected from adjacent slats near transition faces 54 and 54', since the two reflected waves will be approximately 90° out of phase. In the Somerset installation, the length of reflective faces 52 and 52' is 88 mm. (note that, for ease of manufacture, reflective faces 42, 42', 52, and 52' are all of the same length in the Somerset installation) and the length of transition faces 54 and 54' is 13 mm. ($\lambda_2/4$). These two lengths result in the angle $\beta$ of slats 50 and 50' being 8.5°. These dimensions will cause attenuation of signals having a frequency in the range of 6 GHz, corresponding approximately to a typical satellite uplink frequency. This results in attenuation of a signal of frequency $f_2$, as shown by the out-of-phase wave portions B and B' in FIG. 4.

Typical satellite communication downlink frequencies range from 3.70 GHz to 4.20 GHz, while typical satellite communication uplink frequencies range from 5.925 GHz to 6.425 GHz. The Somerset installation is optimized to eliminate interference at approximately midband of the 4 GHz and 6 GHz common carrier bands. While the greatest attenuation occurs at the design frequencies, the shield provides significant attenuation of interference through the above frequency ranges. Obviously, the dimensions of the shield may be designed to attenuate interference in other microwave bands.

It should be apparent that only one set of two slats is necessary, at a minimum, to cause reflection and attenuation of a single frequency, although the optimum design for a particular application may call for a greater number of slats or sets of slats. In the preferred embodiment, two frequencies and two sets of interleaved slats are illustrated. Note, however, that slats 40—40' and slats 50—50' need not be interleaved as shown, but could be placed in different arrangements such as one set of slats on the upper portion of the wall with the other set of slats located at the lower portion of the wall. For proper reflection of energy out of the shield, however, the slats are preferably oriented in a generally horizontal position with respect to the ground, as shown in FIG. 4. The slats may, however, be tilted to mismatch the polarization of the antenna feed or the interfering signals. The distance between two reflective faces of a pair of cooperating slats is set at approximately one-half of the wavelength the signal(s) desired to be attenuated.

Figure 5:
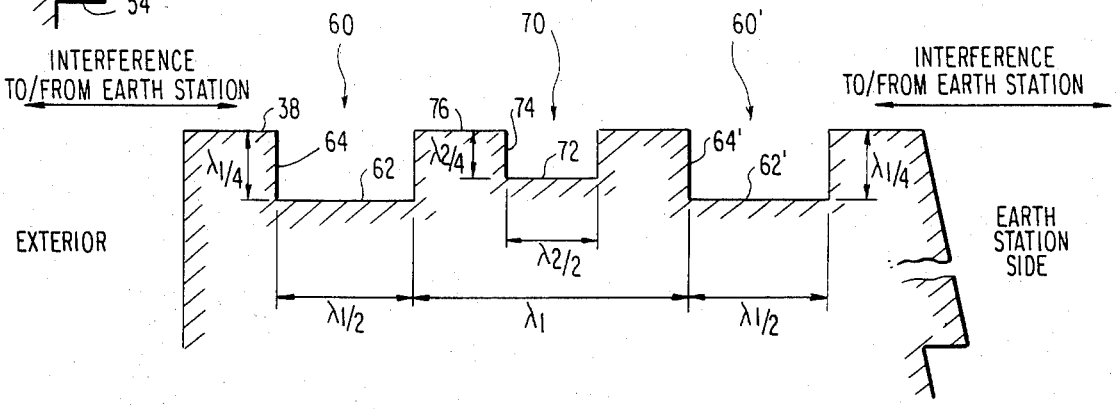
FIG. 5 is a sectional view showing the top face of the wall of the present invention.

Referring now to FIG. 5, the top face 38 of wall 22 is illustrated in greater detail. As shown, top face 38 includes a series of parallel, longitudinally extending grooves indicated generally by reference numerals 60 and 70. Grooves 60 and 70 are designed to attenuate RF interference diffracting over the top 38 of wall 22 and extend substantially transversely to the direction of travel of such RF interference. Groove 60 includes a bottom wall 62 and a side wall 64, which are dimensioned so that groove 60 is resonant at a frequency of approximately $f_1$. Bottom wall 62 has a width corresponding to one-half of the wavelength of frequency $f_1$. Side wall 64 has a length corresponding to one-quarter of the wavelength of the signals of frequency $f_1$. The electromagnetic energy that is diffracted into groove 60 is partially absorbed by the earthen based material of wall 22. The portion of an electromagnetic wave of frequency $f_1$ that is not absorbed is reflected from bottom wall 62 and travels one-half of a wavelength further than the remainder of the wave traveling across top face 38 of wall 22. Thus, the two portions of the wave of frequency $f_1$ are out of phase by 180° or a half-wavelength, and tend to cancel.

Similarly, groove 70 includes a bottom wall 72 and a side wall 74, dimensioned to cause attenuation of electromagnetic energy of frequency $f_2$. Bottom wall 72 has a width corresponding to one-half of the wavelength of frequency $f_2$. Side wall 74 has a length corresponding to one-quarter of the wavelength of the signals of frequency $f_2$.

As indicated previously, in the Somerset installation, frequency $f_1$ corresponds to a downlink frequency of approximately 4 GHz, while frequency $f_2$ corresponds to an uplink frequency of approximately 6 GHz. Corresponding to these frequencies, in the Somerset installation, side wall 64 has a length of 19 mm., and side wall 74 has a length of 13 mm. Also, bottom wall 62 has a length of 38 mm., and bottom wall 72 has a length of 26 mm.

It should be apparent that while only one groove is necessary to provide some attenuation of a given frequency, a series of grooves is desirable to attain greater attenuation. Thus, two grooves 60 and 60' having similar dimensions may be provided for downlink frequency $f_1$. Grooves 60 and 60' are preferably separated from each other by a full wavelength of the downlink frequency ($\lambda_1$) in order to insure that they act independently on electromagnetic energy of approximately frequency $f_1$.

In view of the foregoing, it may be appreciated that the present invention provides an optimum system for an earth station shield. The novel combination of a pit, a berm, and a wall in the present invention allows a satellite earth station to be located on a relatively small parcel of land in a dense radio frequency environment, without requiring an extensive amount of excavation for a deep pit or a large quantity of earth fill for a tall earthen berm. Of course, depending on the size of the antenna, the wall of the present invention may be used without any pit or berm.

The wall of the present invention is advantageously comprised of a series of readily available, easy to construct, modular concrete panels. The concrete panels require little maintenance and are not susceptible to adverse weather conditions. Moreover, the concrete panels provide an aesthetically pleasing shield which is less reflective than previous metal fence designs.

The concrete panels of the present invention are precast with novel inner and upper surfaces designed to attenuate and disperse undesirable electromagnetic interference. Additionally, the shingle-like design of the inner surface advantageously reduces the reflective effect of rain water on the shield.

Obviously, numerous modifications and variations of the present invention are possible in light of the above teachings. It is therefore to be understood that within the scope of the appended claims, the invention may be practiced otherwise than as specifically described herein.

We claim as our invention:

1. Apparatus, comprising:

(a) a pit;

(b) an antenna positioned in said pit;

(c) an earthen berm disposed about said pit and said antenna; and (d) a wall positioned on said earthen berm, said wall comprising a plurality of precast concrete panels for absorbing interfering electromagnetic energy, each of said concrete panels having an inner face facing said antenna, each of said inner faces having slat means comprising at least two parallel slats formed thereon for reflecting the interfering electromagnetic energy away from said antenna and for attenuating the interfering energy by partial destructive interference.

2. Apparatus as recited in claim 1, wherein said wall panels comprises first means for shielding said antenna from electromagnetic energy of a first wavelength, said wall further including a top face.

3. Apparatus as recited in claim 2, wherein said at least two parallel slats each have a first reflective face, said first reflective faces each comprising a substantially planar surface extending at a first angle from the vertical.

4. Apparatus as recited in claim 3, wherein the perpendicular distance between said first reflective faces is substantially equal to one-half of said first wavelength.

5. Apparatus as recited in claim 4, wherein said panels further include second means for shielding said antenna from electromagnetic energy of a second wavelength, said second shielding means including second means formed on said inner face for reflecting electromagnetic energy of said second wavelength away from said antenna, and second means formed on said inner face for attenuating electromagnetic energy of said second wavelength.

6. Apparatus as recited in claim 5, wherein said second reflecting means and said second attenuating means comprise at least two additional parallel slats each having a second reflective face, said second reflective face comprising a substantially planar surface extending at a second angle from the vertical.

7. Apparatus as recited in claim 6, wherein the perpendicular distance between said second reflective faces is substantially equal to one-half of said second wavelength.

8. Apparatus as recited in claim 7, wherein said first wavelength corresponds to a satellite communications downlink frequency and said second wavelength corresponds to a satellite communications uplink frequency.

9. Apparatus as recited in claim 5, wherein said top face comprises at least first and second longitudinally extending grooves.

10. Apparatus as recited in claim 9, wherein said first groove comprises a first side wall and a first bottom wall, and said second groove comprises a second side wall and a second bottom wall.

11. Apparatus as recited in claim 10, wherein the height of said first side wall is substantially equal to one-quarter of said first wavelength, and the height of said second side wall is substantially equal to one-quarter of said second wavelength.

12. Apparatus as recited in claim 11, wherein said first wavelength corresponds to a satellite communications downlink frequency and said second wavelength corresponds to a satellite communications uplink frequency.

13. A shield for a satellite earth station antenna comprising means for shielding the antenna from electromagnetic energy of a first wavelength, comprising a wall including a plurality of precast concrete panels disposed about the antenna for absorbing the energy, said wall having an inner face facing the antenna and first slat means comprising at least first and second parallel slats formed on said inner face for:

(i) reflecting said electromagnetic energy away from the antenna; and for (ii) attenuating said electromagnetic energy by causing at least partial destructive interference of said electromagnetic energy.

14. A shield as recited in claim 13, wherein said wall includes a top face.

15. A shield as recited in claim 13, wherein said first parallel slat has a first reflective face, said first reflective face comprising a substantially planar surface extending at a first angle from the vertical, and said second parallel slat has a second reflective face, said second reflective face comprising a substantially planar surface extending at a second angle from the vertical.

16. A shield as recited in claim 15, wherein the perpendicular distance between said first reflective face and said second reflective face is substantially equal to one-half of said first wavelength.

17. A shield as recited in claim 14, further comprising means for shielding the antenna from electromagnetic energy of a second wavelength, comprising second slat means formed on said inner face for:

(i) reflecting said electromagnetic energy away from the antenna; and (ii) attenuating said electromagnetic energy by causing at least partial destructive interference of said electromagnetic energy.

18. A shield as recited in claim 17, wherein said first and second slat means comprises at least first and second sets of parallel slats, said first set of parallel slats comprising said at least first and second parallel slats having at least a first pair of reflective faces, said first pair of reflective faces each comprising a substantially planar surface extending at a first angle from the vertical, said second set of parallel slats comprising at least a second pair of reflective faces, said second reflective faces each extending at a second angle from the vertical.

19. A shield as recited in claim 18, wherein the perpendicular distance between said first reflective faces is substantially equal to one-half of said first wavelength, and the perpendicular distance between said second reflective faces is substantially equal to one-half of said second wavelength.

20. A shield as recited in claim 19, wherein said parallel slats in each of said sets are positioned adjacent to one another.

21. A shield as recited in claim 19, wherein said parallel slats of said first set are interleaved with parallel slats of said second set.

22. A shield as recited in claim 21, wherein said first wavelength corresponds to a satellite communications downlink frequency and said second wavelength corresponds to a satellite communications uplink frequency.

23. A shield as recited in claim 22, wherein said first wavelength corresponds to a frequency of approximately 4 GHz, and said second wavelength corresponds to a frequency of approximately 6 GHz.

24. A shield as recited in claim 14, wherein said top face comprises at least one longitudinally extending groove.

25. A shield as recited in claim 24, wherein said groove comprises a side wall and a bottom wall.

26. A shield as recited in claim 25, wherein said side wall has a height substantially equal to one-quarter of said first wavelength.

27. A shield as recited in claim 17, wherein said top face comprises first and second longitudinally extending grooves.

28. A shield as recited in claim 27, wherein said first groove comprises a first side wall and a first bottom wall, and said second groove comprises a second side wall and a second bottom wall.

29. A shield as recited in claim 28, wherein the height of said first side wall is substantially equal to one-quarter of said first wavelength, and the height of said second side wall is substantially equal to one-quarter of said second wavelength.

30. A shield as recited in claim 29, wherein said first wavelength corresponds to a satellite communications downlink frequency and said second wavelength corresponds to a satellite communications uplink frequency.

31. A shield as recited in claim 30, wherein said first wavelength corresponds to a frequency of approximately 4 GHz, and said second wavelength corresponds to a frequency of approximately 6 GHz.

32. A shield for a satellite earth station antenna, comprising:

(a) a wall comprising a plurality of concrete panels, each of said panels having an inner face and a top face;

(b) wherein said inner face comprises a surface including a first set of parallel slats comprising at least a first pair of reflective faces, said first reflective faces each comprising a substantially planar surface extending at a first angle from vertical, and a second set of parallel slats comprising at least a second pair of reflective faces, said second faces each comprising a substantially planar surface extending at a second angle from vertical, said parallel slats of said first set being interleaved with said parallel slats of said second set, and wherein the perpendicular distance between said first reflective faces is substantially equal to one-half the wavelength of a satellite communications downlink frequency and the perpendicular distance between said second reflective faces is substantially equal to one-half of the wavelength of a satellite communications uplink frequency, whereby (i) signals of said downlink frequency reflected from said first reflective face are caused to be substantially out of phase and thereby at least partially cancel, and (ii) signals of said uplink frequency reflected from said second reflective faces are caused to be substantially out of phase and thereby at least partially cancel; and (c) wherein said top face comprises at least two sets of longitudinally extending grooves, said first set of grooves comprising a first side wall and a first bottom wall, said second set of grooves comprising a second side wall and a second bottom wall, said first side wall having a height substantially equal to one-quarter of the wavelength of said downlink frequency, said second side wall having a height substantially equal to one-quarter of the wavelength of said uplink frequency, whereby (i) signals of said downlink frequency reflected from said first bottom wall are caused to be substantially out of phase with signals of said downlink frequency reflected from said top face, thereby causing attenuation of signals of said downlink frequency, and (ii) signals of said uplink frequency reflected from said second bottom wall are caused to be substantially out of phase with signals of said uplink frequency reflected from said top face, thereby causing attenuation of signals of said uplink frequency.

33. A shield as recited in claim 32, wherein said satellite communications downlink frequency is approximately 4 GHz and said satellite communications uplink frequency is approximately 6 GHz.

34. A shield for a satellite earth station antenna, comprising:

(a) means for shielding the antenna from electromagnetic energy of a first wavelength, comprising a wall disposed about the antenna and including a plurality of precast concrete panels, each panel comprising an inner face having a first slat and a second slat, said first slat having a first reflective face, said second slat having a second reflective face;

(b) wherein the perpendicular distance between said first reflective face and said second reflective face is substantially equal to one-half of said first wavelength, so that electromagnetic energy of said first wavelength reflected from said first reflective face is substantially out of phase with electromagnetic energy of said first wavelength reflected from said second reflective face, thereby causing attenuation of said electromagnetic energy by destructive interference.

35. A shield for a satellite earth station antenna, comprising: means for shielding the antenna from electromagnetic energy of a first wavelength, comprising a wall disposed about the antenna, said wall including a plurality of precast concrete panels for absorbing the energy, each panel including a top face having a groove that extends substantially transversely to the direction of travel of said electromagnetic energy over said top face of said panel, said groove having a side wall and a bottom wall, said side wall having a height substantially equal to one-quarter of said first wavelength.

36. Apparatus, comprising:

(a) a pit;

(b) an antenna positioned in said pit;

(c) an earthen berm disposed about said pit and said antenna;

(d) a wall positioned on said earthen berm, said wall including an inner face and a top face; and (e) means for shielding said antenna from electromagnetic energy of a first wavelength including means for reflecting said electromagnetic energy away from said antenna and means for attenuating said electromagnetic energy by causing destructive interference of said electromagnetic energy, said shielding means further comprising:

(i) first and second slats positioned on said inner face, said first slat having a first reflective face, said second slat having a second reflective face, wherein the perpendicular distance between said first reflective face and said second reflective face is substantially equal to one-half of said first wavelength; and (ii) a longitudinally extending groove in said top face, wherein said groove has a side wall and a bottom wall, said side wall having a height substantially equal to one-quarter of said first wavelength.

37. A shield for a satellite earth station antenna, which comprises:

(a) wall means positioned about the antenna for absorbing interfering electromagnetic energy;

(b) said wall means comprising a plurality of precast concrete panels;

(c) wherein each of said panels includes an inner face that faces the antenna, an outer face on the opposite side of said inner face, and a top face connecting said inner and outer faces;

(d) wherein said inner face includes slat means comprising at least one set of parallel slats formed thereon for attenuating interfering electromagnetic energy by causing destructive interference of interfering electromagnetic energy.

38. A shield as set forth in claim 37, wherein said attenuating means comprises means for reflecting interfering electromagnetic energy so as to phase cancel itself.

39. A shield as set forth in claim 38, wherein said reflecting means comprises said at least one set of parallel slats having a first pair of reflective faces separated by approximately one-half the wavelength of a first satellite communications frequency desired to be attenuated.

40. A shield as set forth in claim 39, wherein said reflecting means further comprises a second set of parallel slats having a second set of reflective faces separated by approximately one-half the wavelength of a second satellite communications frequency desired to be attenuated.

41. A shield as set forth in claim 40, wherein said first and second set of slats are interleaved on said inner face of said panel.

42. A shield as set forth in claim 38, wherein said reflecting means include means for reflecting the interfering electromagnetic energy upwardly away from the antenna.

43. A shield as set forth in claim 37, wherein said top face includes further means for attenuating interfering electromagnetic energy.

44. A shield as set forth in claim 43, wherein said further attenuating means comprises at least one groove means extending longitudinally along said top face for causing destructive interference of a satellite communications signal of a first frequency.

45. A shield as set forth in claim 44, wherein said attenuating means comprises second groove means extending longitudinally along said top face for causing destructive interference of a satellite communications signal of a second frequency.

46. A shield as set forth in claim 37, wherein said plurality of concrete panels each include means for causing destructive interference of two distinct RF signals.

47. A shield as set forth in claim 46, wherein said two distinct RF signals comprise a satellite communications uplink frequency signal and a satellite communications downlink frequency signal.

48. A shield as set forth in claim 37, wherein said inner face further includes means formed thereon for reflecting interfering electromagnetic energy upwardly away from the antenna.

* * * * *